US007892018B1

(12) United States Patent
Tobey

(10) Patent No.: US 7,892,018 B1
(45) Date of Patent: Feb. 22, 2011

(54) ELECTRICAL CONNECTOR ASSEMBLY WITH TWO CABLE LOADING STOP ELEMENTS

(75) Inventor: Shawn Phillip Tobey, Trinity, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/569,362

(22) Filed: Sep. 29, 2009

(51) Int. Cl.
*H01R 4/24* (2006.01)

(52) U.S. Cl. ..... 439/441

(58) Field of Classification Search ..... 439/436–441, 439/858, 444
See application file for complete search history.

(56) References Cited

U.S. PATENT DOCUMENTS

| | | | | |
|---|---|---|---|---|
| 1,725,883 | A | 8/1929 | Recker | |
| 1,830,250 | A | 11/1931 | Tiefenbacher | |
| 3,858,151 | A | 12/1974 | Paskert | |
| 4,441,776 | A | 4/1984 | Anhalt | |
| 4,711,507 | A | 12/1987 | Noorily | |
| 4,737,118 | A | 4/1988 | Lockard | |
| 5,445,538 | A | 8/1995 | Rodrigues et al. | |
| 5,732,984 | A | 3/1998 | Bartholomew | |
| 5,866,853 | A | 2/1999 | Sheehan | |
| 5,975,940 | A * | 11/1999 | Hartmann et al. | 439/441 |
| 6,056,586 | A | 5/2000 | Lin | |
| 6,077,122 | A | 6/2000 | Elkhatib et al. | |
| 6,142,828 | A | 11/2000 | Pepe | |
| 6,238,231 | B1 | 5/2001 | Chapman et al. | |
| 6,346,005 | B1 | 2/2002 | Viklund et al. | |
| 6,422,884 | B1 | 7/2002 | Babasick et al. | |
| 6,582,248 | B2 | 6/2003 | Bachman | |
| 6,872,886 | B2 | 3/2005 | Kiely | |
| 6,953,362 | B2 | 10/2005 | Mossner et al. | |
| 7,056,148 | B2 * | 6/2006 | Staniszewski et al. | 439/444 |
| 7,384,298 | B2 | 6/2008 | Caveney et al. | |
| 7,401,402 | B2 | 7/2008 | Bresche et al. | |
| 7,404,739 | B2 | 7/2008 | Shields et al. | |
| 7,432,452 | B2 | 10/2008 | Gardner | |
| 7,727,002 | B2 * | 6/2010 | Bethurum et al. | 439/441 |
| 2001/0027043 | A1 | 10/2001 | Shiraki et al. | |
| 2002/0155746 | A1 | 10/2002 | Simpson | |
| 2003/0100215 | A1 | 5/2003 | Bachman | |
| 2005/0106946 | A1 | 5/2005 | Doorhy et al. | |
| 2005/0202697 | A1 | 9/2005 | Caveney et al. | |
| 2007/0141908 | A1 | 6/2007 | Bert et al. | |
| 2007/0240902 | A1 | 10/2007 | Tapper | |
| 2007/0278006 | A1 | 12/2007 | Gardner | |

* cited by examiner

*Primary Examiner*—Chandrika Prasad

(57) ABSTRACT

An electrical connector assembly includes a housing and a cable loading stop element. The housing extends between a cable receiving end and an opposite mating end. The housing includes an inner surface that defines an opening extending through the housing from the cable receiving end to the mating end. The opening is shaped to receive a cable that is loaded into the housing through the cable receiving end. The cable loading stop element is coupled to the housing and protrudes into the opening from the inner surface of the housing. The cable loading stop element limits a distance that a jacket of the cable is loaded into the housing while permitting a wire disposed within the jacket of the cable to be moved within the opening across the cable loading stop element.

17 Claims, 5 Drawing Sheets

ELECTRICAL CONNECTOR ASSEMBLY WITH TWO CABLE LOADING STOP ELEMENTS

BACKGROUND OF THE INVENTION

The subject matter herein relates generally to electrical connector assemblies, and more particularly to electrical connector assemblies having cables loaded into the assemblies.

Various electronic systems, such as those used to transmit signals in the telecommunications industry, include connector assemblies with electrical wires arranged in differential pairs. One wire in the differential pair carries a positive signal and the other wire carries a negative signal intended to have the same absolute magnitude, but at an opposite polarity. An RJ-45 electrical connector is one example of a connector used to transmit electrical signals in differential pairs. The electrical connector may either be a plug or an outlet jack that is terminated to the end of a cable having individual wires.

In some known electrical connector assemblies, a housing of the assembly includes a central passageway that receives a cable loaded into the housing. The central passageway ends at a structure extending across the central passageway. For example, the housing may include crossed bars that extend across the passageway to prevent the cable from being loaded too far into the housing. The bars typically extend completely across the passageway. The crossed bars define several smaller openings through which the differential pair wires of the cable may be loaded, or laced, through. The wires are placed through the smaller openings defined by the bars and are terminated to one or more contacts located in the housing on the opposite side of the bars.

But, in order to ensure that the wires are aligned with the proper contacts in the housing, the cable and wires must be aligned with the corresponding smaller openings defined by the bars. That is, the wires must be aligned with the openings that are close to the contacts to which the wires are terminated. If the wires are not aligned with the smaller openings defined by the bars prior to loading the cable into the housing, the wires may not be able to be laced through the smaller openings and terminated to the correct contacts. As a result, the cable and wires must be repeatedly removed from and loaded into the housing and re-aligned with the smaller openings until the wires are aligned with the proper openings. The repeated removal and realignment of the cable and wires adds increased time and complexity in assembling the connector assemblies. Thus, a need exists for an improved connector assembly that reduces the complexity in lacing wires of a cable through the housing of the connector assembly.

BRIEF DESCRIPTION OF THE INVENTION

In one embodiment, an electrical connector assembly is provided. The connector assembly includes a housing and a cable loading stop element. The housing extends between a cable receiving end and an opposite mating end. The housing includes an inner surface that defines an opening extending through the housing from the cable receiving end to the mating end. The opening is shaped to receive a cable that is loaded into the housing through the cable receiving end. The cable loading stop element is coupled to the housing and protrudes into the opening from the inner surface of the housing. The cable loading stop element limits a distance that a jacket of the cable is loaded into the housing while permitting a wire disposed within the jacket of the cable to be moved within the opening across the cable loading stop element. Optionally, the cable loading stop element is a cantilevered beam projecting into the opening. The cable loading stop element may radially project into the opening from a first side of the inner surface toward an opposing second side of the inner surface and is separated from the second side by a gap. In one embodiment, the electrical connector assembly includes a plurality of the cable loading stop elements, with each cable loading stop element extending from the inner surface to an outer end disposed within the opening. The outer ends may be separated from one another by a gap in the opening.

In another embodiment, another electrical connector assembly is provided. The connector assembly includes a jack housing, a wire lacing housing and a cable loading stop element. The jack housing includes a connector interface that is configured to mate with a peripheral connector and an opposite back end. The wire lacing housing extends between a cable receiving end that is configured to receive a cable and an opposite mating end that is configured to engage the back end of the jack housing. The wire lacing housing includes an inner surface that defines an opening shaped to receive the cable. The cable loading stop element protrudes from the inner surface of the wire lacing housing into the opening. The cable loading stop element is configured to limit a distance that a jacket of the cable is loaded into the opening while permitting a wire disposed within the jacket of the cable to be moved within the opening across the cable loading stop element. The jack housing mates with the peripheral connector to electrically couple the wire in the cable with the peripheral connector. Optionally, the opening extends along a center axis through the wire lacing housing. At least one of the inner surface and the cable loading stop element includes a ramped surface that is configured to guide the cable toward the center axis of the opening. The ramped surface is configured to guide cables of different diameters toward the center axis of the opening. In one embodiment, the opening extends along a center axis through the wire lacing housing. The cable loading stop element may include a sloped surface that extends around the inner surface of the housing. The sloped surface decreases an inside diameter of the opening along the center axis.

DETAILED DESCRIPTION OF THE INVENTION

Figure 1:
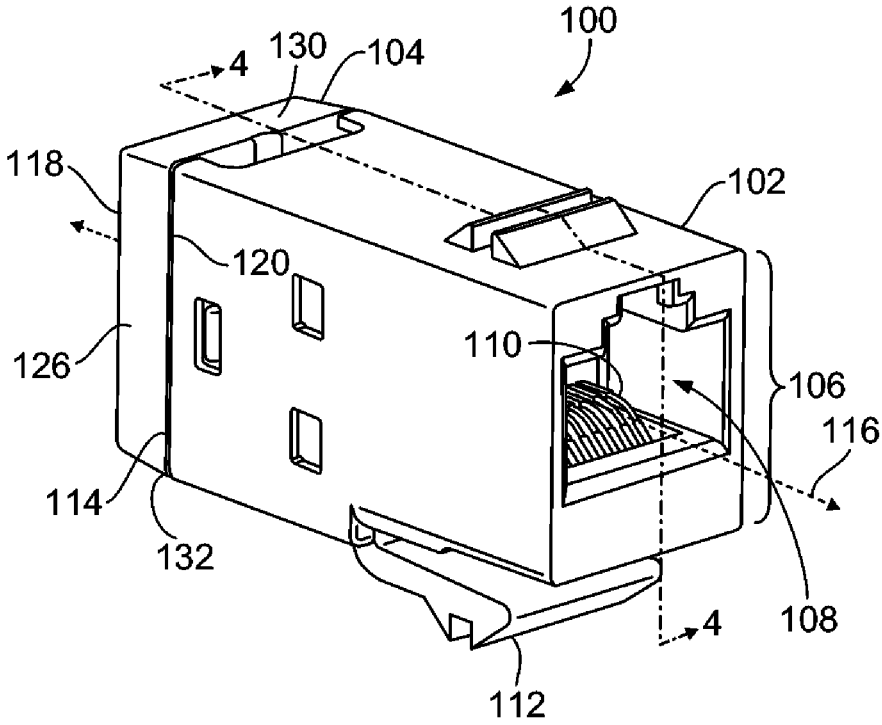
FIG. 1 is a front perspective view of an electrical connector assembly formed in accordance with an example embodiment.
Figure 2:
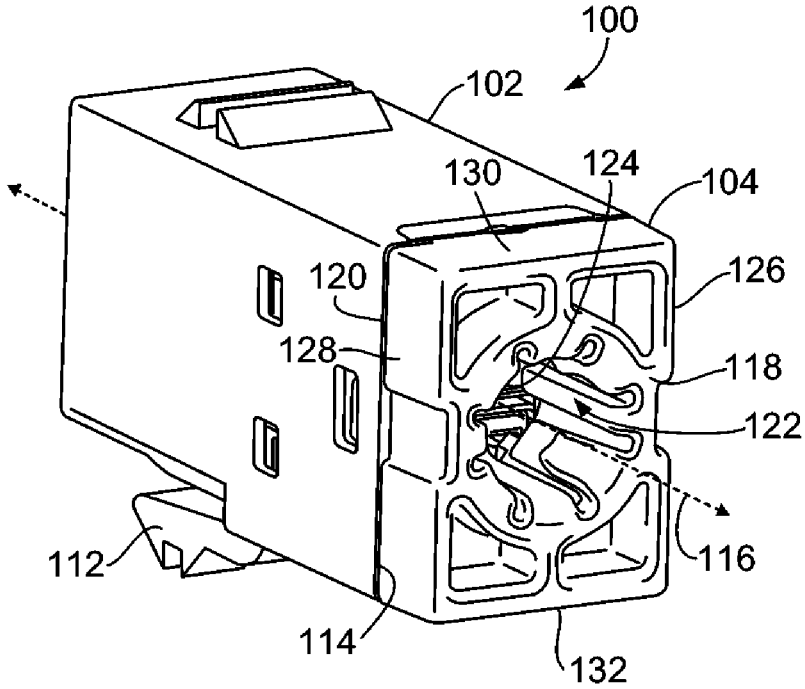
FIG. 2 is a rear perspective view of the connector assembly shown in FIG. 1.

FIG. 1 is a front perspective view of an electrical connector assembly 100 formed in accordance with an example embodiment. FIG. 2 is a rear perspective view of the connector assembly 100. The connector assembly 100 is illustrated as an RJ-45 jack or receptacle, however the subject matter described herein may be used with other types of electrical connectors. The RJ-45 jack shown in the attached Figures is merely illustrative. In one embodiment, the connector assembly 100 is similar to the electrical connectors described in co-pending U.S. patent application Ser. No. 12/143,291, entitled "Electrical Connector With A Compliant Cable Restraint Relief Element." The subject matter of U.S. patent application Ser. No. 12/143,291 is incorporated by reference herein in its entirety.

The connector assembly 100 includes a jack housing 102 joined with a wire lacing housing 104. In the illustrated embodiment, the connector assembly 100 is elongated along a major axis 116. The jack housing 102 and the wire lacing housing 104 may include or be formed from one or more dielectric materials. For example, one or more of the jack housing 102 and the wire lacing housing 104 may be molded from a polymer. Alternatively, the jack housing 102 and/or the wire lacing housing 104 may include or be formed from a conductive material, such as a metal.

The jack housing 102 extends between a connector interface 106 and an opposite back end 114. The back end 114 engages and mates with the wire lacing housing 104 to secure the jack housing 102 with the wire lacing housing 104. The connector interface 106 is shaped to mate with a peripheral connector (not shown). In the embodiment shown in FIGS. 1 and 2, the connector interface 106 is shaped to receive an RJ-45 plug (not shown) inserted into a connector port 108 in the jack housing 102. Several jack contacts 110 are disposed within the connector port 108. The jack contacts 110 engage corresponding contacts (not shown) in the peripheral connector to electrically couple the connector assembly 100 with the peripheral connector.

The connector assembly 100 includes a latching mechanism 112 that may be used to secure the connector assembly 100 with a device (not shown). For example, the connector assembly 100 may be loaded into an opening (not shown) of a panel (not shown) in a computing device (not shown), with the latching mechanism 112 engaging the panel to secure the connector assembly 100 in the computing device. Alternatively, a different latching or securing mechanism may be used to secure the connector assembly 100 in a device.

The wire lacing housing 104 extends between a cable receiving end 118 to an opposite mating end 120. The cable receiving end 118 and the mating end 120 are interconnected by opposite edges 126, 128 and opposite edges 130, 132. The mating end 120 engages the back end 114 of the jack housing 102 to couple the wire lacing housing 104 with the jack housing 102. The cable receiving end 118 includes an opening 122 that is shaped to receive a cable 400 (shown in FIG. 4) into the connector assembly 100. The cable 400 may be loaded into the cable receiving end 118 in a direction along the major axis 116. The cable receiving end 118 includes an inner surface 124 that defines or frames the opening 122. In the illustrated embodiment, the inner surface 124 defines an approximately circular opening 122 that is centered about the major axis 116. The opening 122 extends through the wire lacing housing 104 from the cable receiving end 118 to the mating end 120. The cable 400 is loaded into the wire lacing housing 104 via the opening 122. The cable 400 is loaded into the connector assembly 100 to electrically couple the cable 400 with the connector assembly 100. The connector assembly 100 electrically joins the cable 400 with a peripheral connector (not shown) that mates with the jack housing 102.

Figure 3:
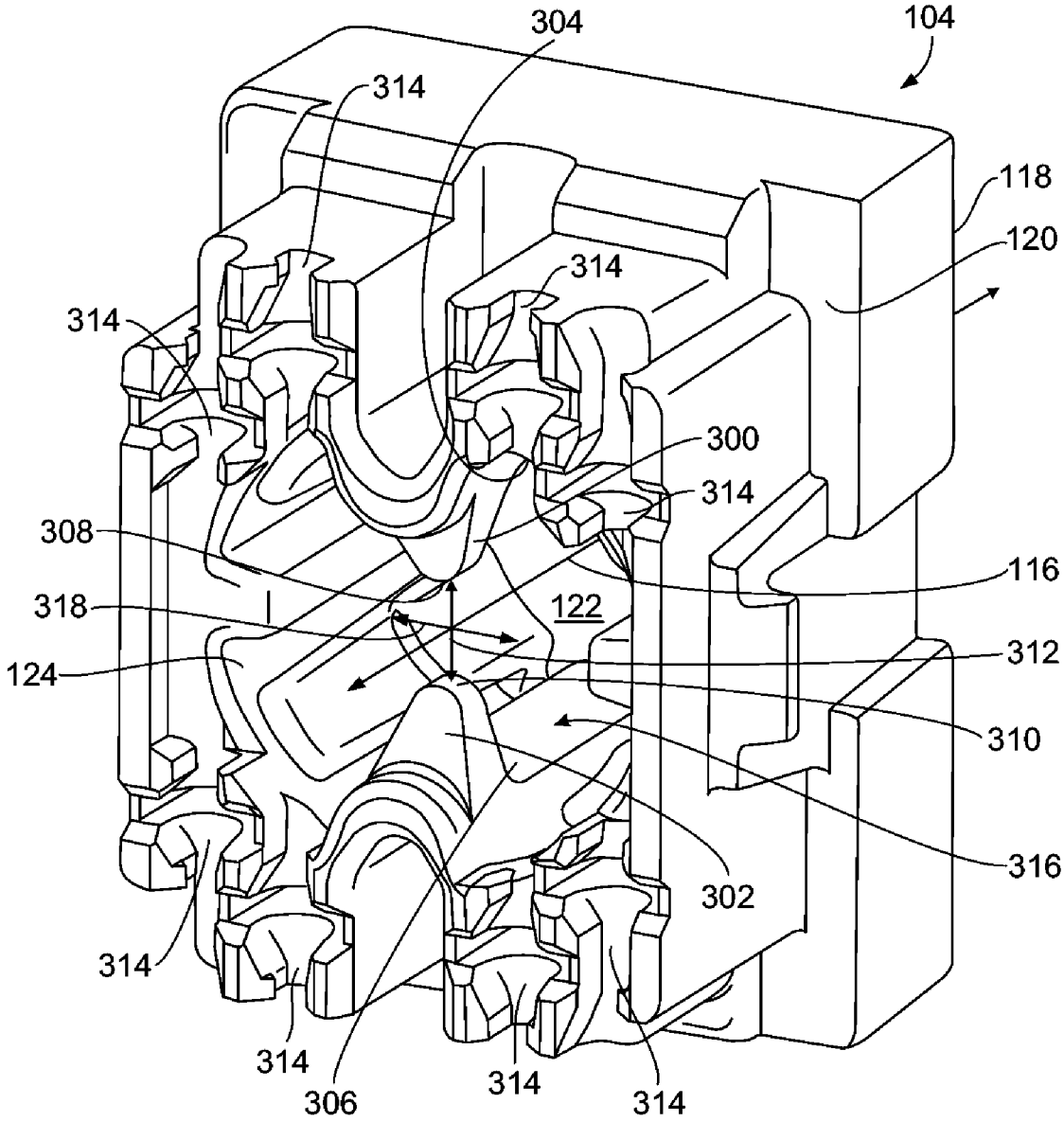
FIG. 3 is a perspective view of a wire lacing housing shown in FIG. 1 in accordance with one example embodiment.

FIG. 3 is a perspective view of the wire lacing housing 104 in accordance with one example embodiment. The wire lacing housing 104 includes cable loading stop elements 300, 302 that protrude from the inner surface 124 into the opening 122. In the illustrated embodiment, the wire lacing housing 104 includes a pair of cable loading stop elements 300, 302 coupled with the inner surface 124. A different number of cable loading stop elements 300, 302 may be provided in an alternative embodiment. For example, a single cable loading stop element 300, 302 may be provided or more than two cable loading stop elements 300, 302 may be included in the wire lacing housing 104. The cable loading stop elements 300, 302 radially extend into the opening 122 toward one another. For example, the cable loading stop element 300 protrudes from a first side 304 of the inner surface 124 toward an opposing second side 306 while the cable loading stop element 302 extends from the second side 306 toward the opposing first side 304.

The cable loading stop elements 300, 302 in the illustrated embodiment are located along the major axis 116 proximate to the mating end 120. For example, the cable loading stop elements 300, 302 are coupled to the inner surface 124 in positions closer to the mating end 120 than the cable receiving end 118 of the wire lacing housing 104. Alternatively, the cable loading stop elements 300, 302 may be located in a different position along the major axis 116.

The cable loading stop elements 300, 302 are circumferentially displaced from one another along the circumference of the inner surface 124. In the illustrated embodiment, the cable loading stop elements 300, 302 are displaced approximately 180 degrees from one another along the circumference of the inner surface 124. Alternatively, the cable loading stop elements 300, 302 may be displaced closer or farther from one another.

In one embodiment, the inner surface 124 includes channels 316 located near each of the cable loading stop elements 300, 302. While the channel 316 located proximate to the cable loading stop element 300 is not visible in FIG. 3, the channel 316 disposed near the cable loading stop element 302 may be substantially identical to the channel 316 located proximate to the cable loading stop element 300. The channels 316 extend from the cable receiving end 118 to the cable loading stop elements 300, 302. The channels 316 include a concave surface that is shaped to approximately fix the outer diameter of the cable 400 (shown in FIG. 4). For example, the outer surface of the cable 400 and the channels 316 may have complementary shapes such that the cable 400 is received within the channels 316 when the cable 400 is loaded into the opening 122.

The channels 316 are tapered in one embodiment. For example, the channels 316 may be tapered to provide an interference fit between the channels 316 and the cable 400 (shown in FIG. 4) when the cable 400 is loaded into the opening 122. The channels 316 can be tapered such that the surfaces of the channels 316 that engage the cable 400 are angled with respect to the major axis 116 and angled toward one another. For example, the surfaces of the channels 316 may be closer to one another in a direction approximately perpendicular to the major axis 116 at or near the cable loading stop elements 300, 302 than a location at or near the cable receiving end 118.

The mating end 120 of the wire lacing housing 104 includes several wire lacing slots 314. The wire lacing slots 314 are shaped to receive wires 404 (shown in FIG. 4) of the cable 400 (shown in FIG. 4). For example, the cable 400 may include several wires 404 surrounded by an insulative sheath. The wires 404 are positioned and held in corresponding wire lacing slots 314 after the cable 400 is loaded into the connector assembly 100. Insulation displacement terminals (not shown) that are held in the jack housing 102 (shown in FIG. 1) displace insulation of the wires 404 held in the wire lacing slots 314 to electrically couple the terminals with the wires 404. The terminals are then electrically joined with the jack contacts 110 (shown in FIG. 1) to electrically connect the cable 400 with the jack contacts 110. Particular wires 404 or pairs of the wires 404 correspond to different terminals or jack contacts 110. As a result, certain wires 404 may need to be placed into particular wire lacing slots 314 in order to correctly couple the wires 404 with the proper jack contacts 110. While eight wire lacing slots 314 are shown in FIG. 3, a different number of wire lacing slots 314 may be provided.

As shown in FIG. 3, each of the cable loading stop elements 300, 302 is a cantilevered beam that extends from the inner surface 124 to a corresponding outer end 308, 310. The outer ends 308, 310 are separated from one another by a gap 312 that extends in a direction approximately perpendicular to a lateral axis 318. In the illustrated embodiment, the lateral axis 318 is disposed perpendicular to the major axis 116. The cable loading stop elements 300, 302 are positioned in the wire lacing housing 104 to limit a distance that the cable 400 (shown in FIG. 4) can be loaded into the opening 122 along the major axis 116. For example, the cable 400 may be loaded into the opening 122 through the cable receiving end 118 and along the major axis 116 of the connector assembly 100 (shown in FIG. 1). The cable 400 is loaded into the opening 122 until the cable 400 contacts or engages the cable loading stop elements 300, 302. The cable loading stop elements 300, 302 prevent the cable 400 from being loaded into the connector assembly 100 past or beyond the cable loading stop elements 300, 302 along the major axis 116. For example, the cable loading stop elements 300, 302 may abut a jacket 406 (shown in FIG. 4) of the cable 400 to prevent the jacket 406 from being moved into the connector assembly 100 further than the elements 300, 302.

Figure 4:
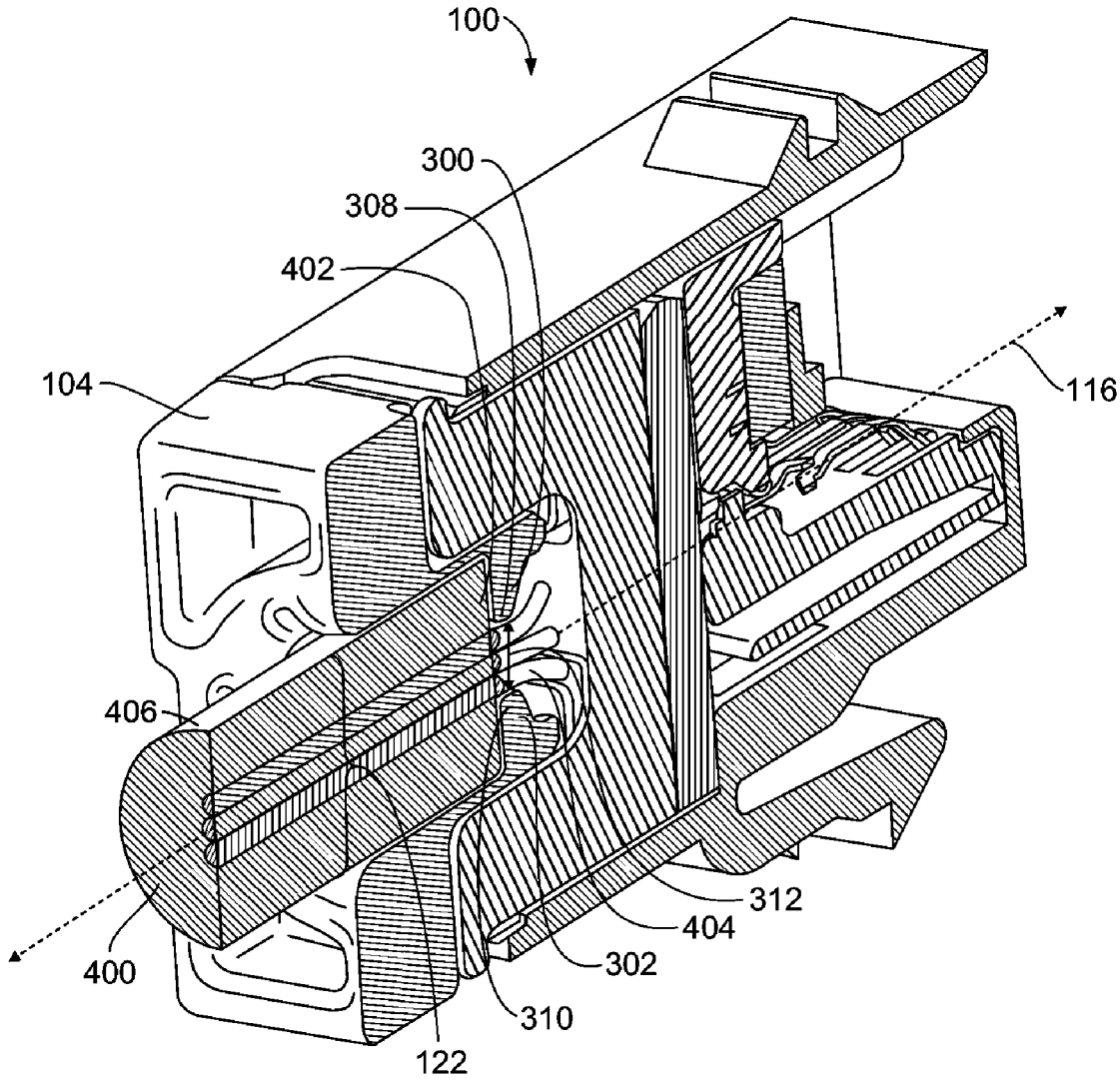
FIG. 4 is a perspective cross-sectional view of the connector assembly shown in FIG. 1 in accordance with one embodiment.

FIG. 4 is a perspective cross-sectional view of the connector assembly 100 with the cable 400 loaded therein taken along line 4-4 shown in FIG. 1 in accordance with one embodiment. The cable 400 includes an end portion 402. The end portion 402 is an outer end of the cable 400 that engages the cable loading stop elements 300, 302 when the cable 400 is loaded into the connector assembly 100. The engagement between the end portion 402 and the cable loading stop elements 300, 302 prevents the cable 400 from being loaded into the connector assembly 100 along the major axis 116 beyond or past the cable loading stop elements 300, 302.

The cable 400 includes the jacket 406 that circumferentially encloses several wires 404 longitudinally extending along the length of the cable 400. The jacket 406 may include, or be formed from a dielectric material, such as one or more polymers. In the illustrated embodiment, the jacket 406 is an outer jacket that defines an exterior surface of the cable 400. In another embodiment, the jacket 406 may be an inner jacket that circumferentially encloses one or more of the wires 404 along a length of the cable 400 and that is disposed within an outer jacket. For example, the cable 400 may include several inner jackets that enclose pairs of the wires 404 and that are disposed within the illustrated outer jacket 406. Alternatively, the jacket 406 may include or be formed from a conductive body that circumferentially encloses one or more of the wires 404 along a length of the cable 400. For example, the jacket 406 may be a cable shield that encloses and shields one or more of the wires 404 from electromagnetic interference and that is disposed within an inner and/or outer dielectric jacket.

The wires 404 may be provided in differential pairs. For example, pairs of the wires 404 in the cable 400 can be configured to communicate a differential signal. The wires 404 extend beyond the end portion 402 of the cable 400. As described above, the wires 404 are loaded into the wire lacing slots 314 (shown in FIG. 3) of the wire lacing housing 104. Also as described above, the outer ends 308, 310 are separated by the gap 312, which represents an open area through which wires 404 may be moved. After loading the cable 400 into the connector assembly 100, the wires 404 may be moved across or between the outer ends 308, 310 of the cable loading stop elements 300, 302 to align the wires 404 with the corresponding wire lacing slots 314. For example, the wires 404 may be moved in directions approximately parallel to the lateral axis 318 (shown in FIG. 3) through the gap 312 relative to the cable 400 and the cable loading stop elements 300, 302 after the cable 400 is placed in the opening 122. Therefore, the cable 400 and wires 404 do not need to be aligned with the wire lacing slots 314 prior to loading the cable 400 into the connector assembly 100. Instead, the cable 400 can be loaded into the connector assembly 100 without aligning the wires 404 with the wire lacing slots 314 because the wires 404 can later be moved within the gap 312 in the opening 122 and laterally across the cable loading stop elements 300, 302 and toward one or more of the edges 126, 128 (shown in FIG. 1) of the wire lacing housing 104 to locate the wires 404 in the proper wire lacing slots 314. In the illustrated embodiment, the cable 400 is loaded into the wire lacing housing 104 in a direction along the major axis 116 while the wires 404 may be moved within the wire lacing housing 104 across and/or between the cable loading stop elements 300, 302 in lateral directions that are generally along the lateral axis 318 and angled with respect to the major axis 116.

Figure 5:
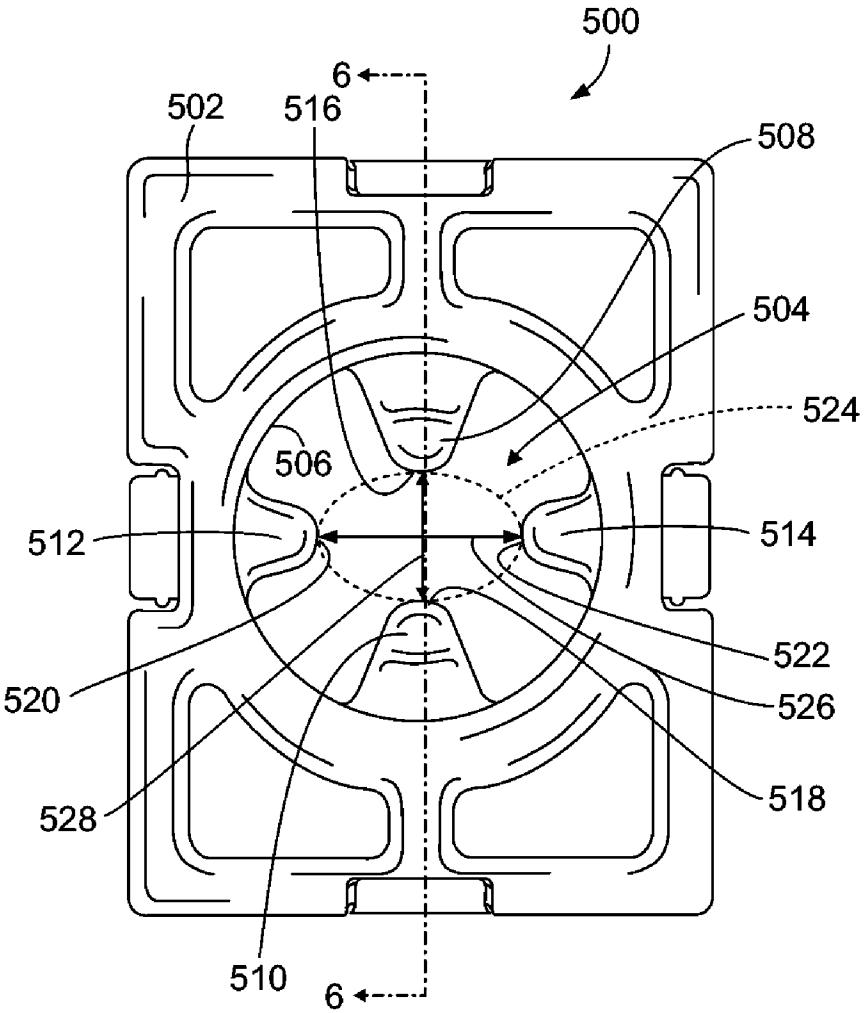
FIG. 5 is an elevational view of a wire lacing housing according to an alternative embodiment.

FIG. 5 is an elevational view of a wire lacing housing 500 according to an alternative embodiment. The wire lacing housing 500 is similar to the wire lacing housing 104 shown in FIG. 1. For example, the wire lacing housing 500 may be joined with the jack housing 102 (shown in FIG. 1) to assemble a connector assembly that is similar to the connector assembly 100 (shown in FIG. 1). The wire lacing housing 500 may include or be formed from one or more dielectric materials. Alternatively, the wire lacing housing 500 may include or be formed from a conductive material, such as a metal.

Figure 6:
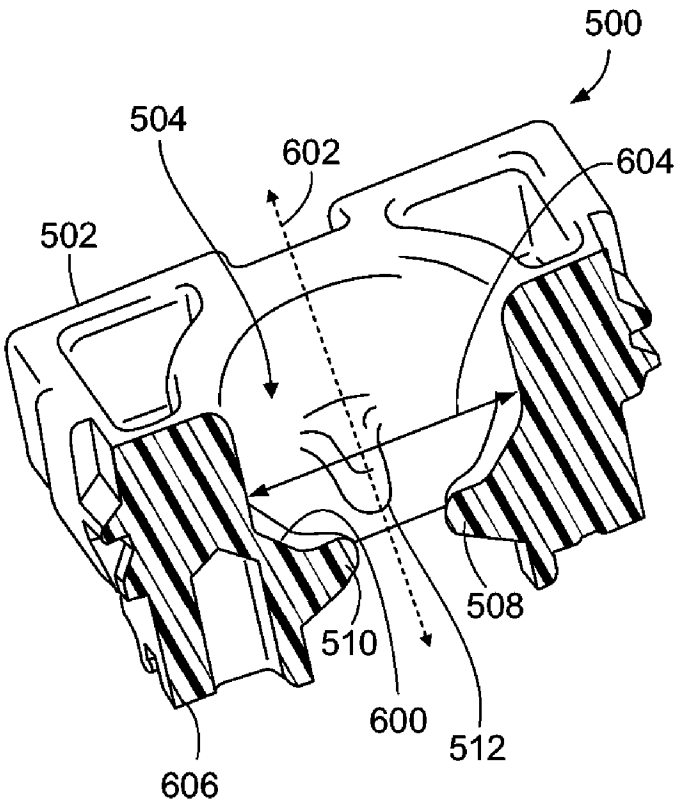
FIG. 6 is a perspective cross-sectional view of the wire lacing housing shown in FIG. 5 in accordance with one embodiment.

The wire lacing housing 500 extends between a cable receiving end 502 to an opposite mating end 606 (shown in FIG. 6). The mating end 606 of the wire lacing housing 500 may be substantially identical to the mating end 120 (shown in FIG. 1) of the wire lacing housing 104 (shown in FIG. 1). The cable receiving end 502 includes an opening 504 that is similar to the opening 122 (shown in FIG. 1). For example, the opening 504 is shaped to receive a cable 400 (shown in FIG. 4). The cable receiving end 502 includes an inner surface 506 that is similar to the inner surface 124 (shown in FIG. 1). The inner surface 506 defines or frames the opening 504.

In contrast to the wire lacing housing 104 (shown in FIG. 1), the wire lacing housing 500 includes four cable loading stop elements 508-514. Similar to the cable loading stop elements 300, 302 (shown in FIG. 3), the cable loading stop elements 508-514 engage the cable 400 (shown in FIG. 4) to limit the distance that the cable 400 is loaded into the wire lacing housing 500. The cable loading stop elements 508-514 are arranged in opposing pairs. For example, the cable loading stop elements 508, 510 in one pair oppose one another and extend from opposite sides of the inner surface 506 and toward one another. The cable loading stop elements 512, 514 in another pair oppose one another and extend from opposite sides of the inner surface 506 and toward one another. The cable loading stop elements 508-514 are circumferentially displaced from one another along the circumference of the inner surface 506 by approximately equal distances. Alternatively, the cable loading stop elements 508-514 are circumferentially displaced from one another along the circumference of the inner surface 506 by different distances.

Outer ends 516-522 of the cable loading stop elements 508-514 in each pair are separated from one another by a gap 526, 528. The outer ends 516, 518 of the cable loading stop elements 508, 510 in one pair are separated from one another by the gap 526 while the outer ends 520, 522 of the cable loading stop elements 512, 514 in another pair are separated from one another by the gap 528. An open area 524 is located between the outer ends 516-522 and includes the gaps 526, 528. Similar to the gap 312 (shown in FIG. 3), the gaps 526, 528 and open area 524 permit wires 404 (shown in FIG. 4) of the cable 400 (shown in FIG. 4) to be moved within the opening 504 relative to the cable 400 and the cable loading stop elements 508-514. The wires 404 may be moved in order to align and position the wires 404 with respect to the wire lacing slots 314 (shown in FIG. 3) of the wire lacing housing 500. For example, the cable 400 may be loaded into the opening 504 without aligning the wires 404 with the wire lacing slots 314, with the wires 404 being moved across the outer ends 516-522 and between the cable loading stop elements 508-514 to position the wires 404 in the proper wire lacing slots 314 after the cable 400 is loaded into the wire lacing housing 500.

FIG. 6 is a perspective cross-sectional view of the wire lacing housing 500 taken along the line 6-6 shown in FIG. 5 in accordance with one embodiment. As shown in FIG. 6, the cable loading stop elements 508-514 include ramped surfaces 600. The ramped surfaces 600 are angled with respect to one another and with respect to a major axis 602 of the opening 504. In the illustrated embodiment, the major axis 602 also is a center axis of the opening 504. The ramped surfaces 600 are angled toward one another such that an inside diameter 604 of the opening 504 decreases along the major axis 602 from the cable receiving end 502 toward the mating end 606. The ramped surfaces 600 engage the cable 400 (shown in FIG. 4) as the cable 400 is loaded into the opening 504 in order to guide the cable 400 along the major axis 602. For example, the ramped surfaces 600 may center the cable 400 within the opening 504 and the major axis 602 when the cable 400 is loaded into the opening 504. Additionally, the ramped surfaces 600 may guide cables 400 of different diameters toward the center or major axis 602 of the opening 504. For example, cables 400 having outer diameters that are less than the largest inside diameter 604 of the opening 504 may engage one or more ramped surfaces 600 as the cables 400 are loaded into the opening 504. The ramped surfaces 600 engage the cables 400 and guide the cables 400 toward the major axis 602 of the opening 504.

Figure 8:
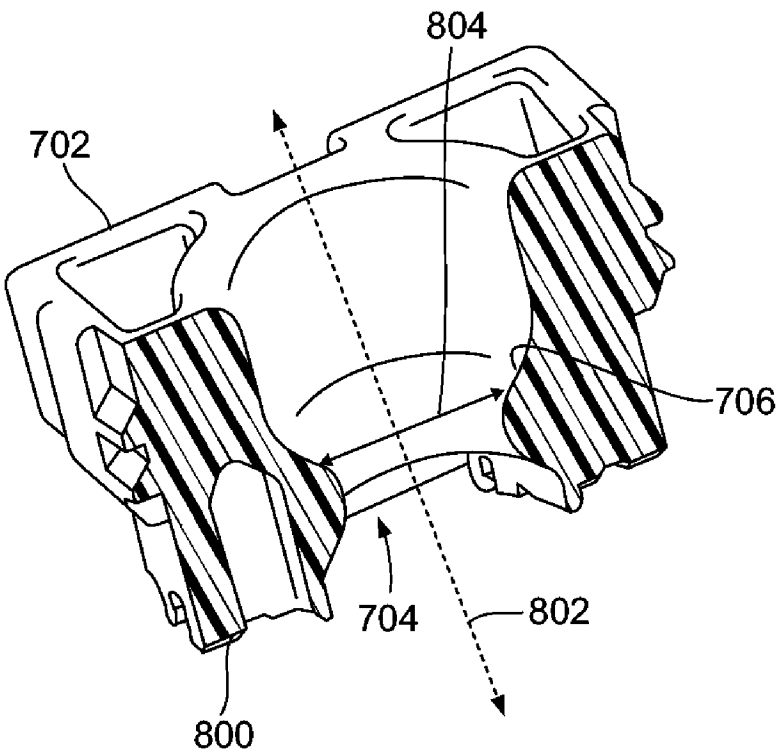
FIG. 8 is a perspective cross-sectional view of the wire lacing housing shown in FIG. 7 in accordance with one embodiment.
Figure 7:
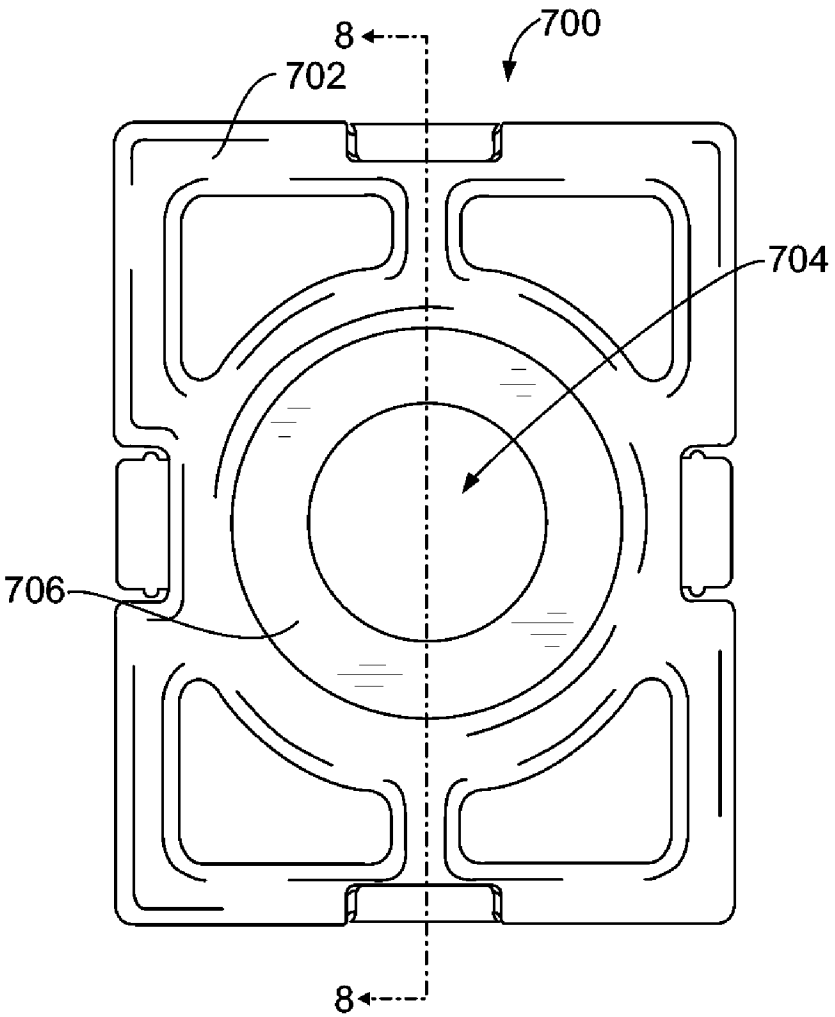
FIG. 7 is an elevational view of a wire lacing housing according to an alternative embodiment.

FIG. 7 is an elevational view of a wire lacing housing 700 according to an alternative embodiment. FIG. 8 is a perspective cross-sectional view of the wire lacing housing 700 taken along line 8-8 in FIG. 7 in accordance with one embodiment. The wire lacing housing 700 is similar to the wire lacing housings 104, 500 shown in FIGS. 1 and 5. For example, the wire lacing housing 700 may be joined with the jack housing 102 (shown in FIG. 1) to assemble a connector assembly that is similar to the connector assembly 100 (shown in FIG. 1). The wire lacing housing 700 may include or be formed from one or more dielectric materials. Alternatively, the wire lacing housing 700 may include or be formed from a conductive material, such as a metal.

The wire lacing housing 700 extends between a cable receiving end 702 to an opposite mating end 800. The mating end 800 may be substantially identical to the mating ends 120, 606 (shown in FIGS. 1 and 5) of the wire lacing housings 104, 500 (shown in FIGS. 1 and 5). The cable receiving end 702 includes an opening 704 that is shaped to receive a cable 400 (shown in FIG. 4). The cable receiving end 702 includes an inner surface 706 that defines or frames the opening 704. The opening 704 extends through the wire lacing housing 700 along a major axis 802. The major axis 802 is a center axis of the opening 704 in the illustrated embodiment.

In contrast to the wire lacing housings 104, 500 (shown in FIGS. 1 and 5), the wire lacing housing 700 does not include discrete cable loading stop elements that protrude into the opening 704 from the inner surface 706. Instead, the inner surface 706 includes a sloped surface that extends around the circumference of the inner surface 706 and that is sloped toward the major axis 802. For example, the inner surface 706 may be sloped toward the major axis 802 such that the opening 704 decreases in size along the major axis 802. An inside diameter 804 of the opening 704 may decrease along the major axis 802 such that the largest inside diameter 804 is disposed proximate to the cable receiving end 702 and the inside diameter 804 decreases along the major axis 802. The inner surface 706 engages the cable 400 (shown in FIG. 4) and guides the cable 400 toward the major, or center, axis 802 of the opening 704. The cable 400 may engage the inner surface 706 through an interference fit to secure the cable 400 in the wire lacing housing 700. The sloped surface of the inner surface 706 is shaped to accommodate cables 400 of varying outer diameters. For example, the inner surface 706 can engage cables 400 of different diameters and guide the cables 400 toward the major axis 802 of the opening 704.

As shown in FIGS. 7 and 8, the opening 704 extends through the wire lacing housing 700. As a result, the opening 704 provides an open area similar to the gaps 312, 526, 528 (shown in FIGS. 3 and 5) and the open area 524 (shown in FIG. 5) to permit wires 404 (shown in FIG. 4) of the cable 400 (shown in FIG. 4) to be moved within the opening 704 relative to the cable 400. The wires 404 may be moved within the opening 704 in order to align and position the wires 404 with respect to the wire lacing slots 314 (shown in FIG. 3) of the wire lacing housing 700. For example, the cable 400 may be loaded into the opening 704 without aligning the wires 404 with the wire lacing slots 314, with the wires 404 being moved within the opening 704 to position the wires 404 in the proper wire lacing slots 314 after the cable 400 is loaded into the wire lacing housing 700.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a housing extending between a cable receiving end and an opposite mating end, the housing including an inner surface defining an opening that extends through the housing from the cable receiving end to the mating end, the opening shaped to receive a cable loaded into the housing through the cable receiving end; and first and second cable loading stop elements coupled to the housing and protruding into the opening from the inner surface of the housing to first and second outer ends disposed in the opening, respectively, the first and second cable loading stop elements limiting a distance that a jacket of the cable is loaded into the housing while permitting a wire disposed within the jacket of the cable to be moved within the opening between the first and second outer ends of the first and second cable loading stop elements.

2. The electrical connector assembly of claim 1, wherein at least one of the first or second cable loading stop elements is a cantilevered beam projecting into the opening.

3. The electrical connector assembly of claim 1, wherein the first cable loading stop element radially projects into the opening from a first side of the inner surface toward an opposite second side of the inner surface and the second cable loading stop element radially projects into the opening from the second side toward the first side.

4. The electrical connector assembly of claim 1, wherein the first and second outer ends are separated from each other by a gap in the opening.

5. The electrical connector assembly of claim 1, wherein the first and second outer ends are disposed within the housing to permit the wire in the cable to be moved within the opening between the first and second outer ends while the cable remains stationary.

6. The electrical connector assembly of claim 1, wherein the opening extends along a center axis through the housing, further wherein at least one of the inner surface, the first cable loading stop element, or the second cable loading stop element includes a ramped surface configured to guide the cable toward the center axis of the opening.

7. The electrical connector assembly of claim 6, wherein the ramped surface is configured to guide cables of different diameters toward the center axis of the opening.

8. The electrical connector assembly of claim 1, wherein the opening extends along a center axis through the housing, further wherein at least one of the first or second cable loading stop elements comprises a sloped surface extending around the inner surface of the housing, the sloped surface decreasing an inside diameter of the opening along the center axis.

9. An electrical connector assembly comprising:

a jack housing including a connector interface configured to mate with a peripheral connector and an opposite back end;

a wire lacing housing extending between a cable receiving end configured to receive a cable and an opposite mating end configured to engage the back end of the jack housing, the wire lacing housing including an inner surface that defines an opening shaped to receive the cable; and first and second cable loading stop elements protruding from the inner surface of the wire lacing housing into the opening, the first and second cable loading stop elements configured to limit a distance a jacket of the cable is loaded into the opening while permitting a wire disposed within the jacket of the cable to be moved within the opening between the first and second cable loading stop elements, wherein the jack housing mates with the peripheral connector to electrically couple the wire in the cable with the peripheral connector.

10. The electrical connector assembly of claim 9, wherein at least one of the first or second cable loading stop elements is a cantilevered beam projecting into the opening.

11. The electrical connector assembly of claim 9, wherein the first cable loading stop element radially projects into the opening from a first side of the inner surface toward an opposing second side of the inner surface and the second cable loading stop element radially projects into the opening from the second side to the first side, the first and second cable loading stop elements separated from each other by a gap within the opening.

12. The electrical connector assembly of claim 9, wherein the first and second cable loading stop elements protrude into the opening to first and second outer ends disposed within the opening, respectively.

13. The electrical connector assembly of claim 9, wherein the first and second outer ends are separated from each other by a gap in the opening.

14. The electrical connector assembly of claim 9, wherein the first and second outer ends are disposed within the housing to permit the wire in the cable to be moved within the opening between the first and second outer ends while the cable remains stationary.

15. The electrical connector assembly of claim 9, wherein the opening extends along a center axis through the wire lacing housing, further wherein at least one of the inner surface, the first cable loading stop element, or the second cable loading stop element includes a ramped surface configured to guide the cable toward the center axis of the opening.

16. The electrical connector assembly of claim 15, wherein the ramped surface is configured to guide cables of different diameters toward the center axis of the opening.

17. The electrical connector assembly of claim 9, wherein the opening extends along a center axis through the wire lacing housing, further wherein at least one of the first cable loading stop element or the second cable loading stop element comprises a sloped surface extending around the inner surface of the housing, the sloped surface decreasing an inside diameter of the opening along the center axis.

* * * * *